US005822675A

United States Patent [19]

Paquet et al.

[11] Patent Number: 5,822,675

[45] Date of Patent: Oct. 13, 1998

[54] HEATING ELEMENTS AND A PROCESS FOR THEIR MANUFACTURE

[75] Inventors: Rene Paquet, Lillois; Eric Vanlathem, Overijse, both of Belgium

[73] Assignee: Dow Corning S.A., Seneffe, Belgium

[21] Appl. No.: 800,084

[22] Filed: Feb. 12, 1997

[51] Int. Cl.[6] ..... H05B 3/10; H05B 3/14; H05B 3/18

[52] U.S. Cl. ..... 428/561; 219/543; 219/544; 219/547; 219/548; 427/387; 427/380; 427/409; 427/419.7; 338/254; 428/447; 428/448; 428/450; 428/562

[58] Field of Search ..... 427/387, 388.1, 427/419.2, 419.7, 409, 380; 219/543, 544, 547, 548; 428/561, 560, 562, 447, 448, 450; 338/331, 258, 254

[56] References Cited

U.S. PATENT DOCUMENTS

| | | | |
|---|---|---|---|
| 4,048,356 | 9/1977 | Bakos et al. | 427/388.1 |
| 4,327,282 | 4/1982 | Nauerth | 219/541 |
| 4,486,495 | 12/1984 | Matsushita et al. | 427/387 |
| 4,808,470 | 2/1989 | Geuskens | 428/323 |
| 4,869,954 | 9/1989 | Squitieri | 427/393.5 |
| 4,915,985 | 4/1990 | Maxfield et al. | 427/419.5 |
| 4,918,814 | 4/1990 | Redmond et al. | 29/878 |
| 5,087,804 | 2/1992 | McGaffigan | 219/10.43 |
| 5,227,093 | 7/1993 | Cole et al. | 427/212 |
| 5,294,374 | 3/1994 | Martinez et al. | 252/521.3 |
| 5,322,520 | 6/1994 | Milder | 604/265 |
| 5,502,548 | 3/1996 | Suzuki et al. | 355/219 |

*Primary Examiner*—Diana Dudash
*Attorney, Agent, or Firm*—Paula J. Lagattuta; Richard I. Gearhart

[57] ABSTRACT

Disclosed is a heating element having improved performance, particularly at high power densities and high temperatures. The heating element comprises a substrate having a first layer comprising a silicon based electrically insulating material on its surface. On a surface of the first layer is a second layer comprising a silicon based electrically resistive material. Attached to the second layer are at least two separate areas of silicon based electrically conductive material. Each of these separate areas are suitable for connection to a power supply.

11 Claims, 1 Drawing Sheet

HEATING ELEMENTS AND A PROCESS FOR THEIR MANUFACTURE

BACKGROUND OF THE INVENTION

1. Field of the Invention

The present invention relates to heating elements and to a process for their manufacture.

2. Description of the Related Art

Heating elements are known in the art. For example, EP0248781 describes a heating element which comprises an insulating support sheet with an electrically conductive layer applied on one of its faces. The electrically conductive layer is derived from a composition consisting of hollow particles of carbon black dispersed in a silicone resin which is soluble in organic solvents. This composition is thermo-hardened to form the electrically conductive layer.

A problem with heating elements known in the art is their poor mechanical and heating performance after repeated exposure to the high temperatures (e.g., 200° C.) and with high power densities (e.g., >10 W/cm$^2$). This poor performance can include thermally generated stress and undesired hot spots which often lead to device failure. For example, assemblies comprising such heating elements often fail after a relatively short period of time (e.g. 50 hours or less) when submitted to 220 volts.

One object of the present invention is to provide a heating element having improved performance, particularly at high power densities and high temperatures.

SUMMARY OF THE INVENTION

The invention provides in one of its aspects a heating element comprising a substrate; on a surface of the substrate, a first layer of material, said first layer being electrically insulating and obtained by curing a composition comprising a silicone resin; on a surface of the first layer, a second layer of material, said second layer being electrically resistive and obtained by curing a composition comprising a silicone resin and electrically conductive filler; attached to the second layer are at least two separate areas of a third material, each of said areas of third material being electrically conductive and suitable for connection to a power supply, said areas of third material obtained by curing a composition comprising a silicone resin and electrically conductive filler.

In another of its aspects, the invention provides a process of manufacturing a heating element comprising supplying a substrate; applying a first composition comprising a silicone resin on a surface of the substrate; curing the first composition to form an electrically insulating layer; applying a second composition comprising a silicone resin and electrically conductive filler on the electrically insulating layer; heating the second composition for a time and at a temperature sufficient to partially cure the second composition; applying a third composition comprising a silicone resin and electrically conductive filler on at least two separate areas of the second composition, each of said separate areas suitable for connection to a power supply; and curing the second and third compositions.

Surprisingly, when such heating elements are connected to 220 volts, power densities higher than 10 W/cm$^2$ and temperatures of 250° C. and more can be achieved and maintained for periods in excess of 1000 hours without heating element failures. Such properties allow the heating elements of the invention to satisfy European Standard EN60335-1 relating to high voltage insulation and leakage current at room temperature.

DETAILED DESCRIPTION OF THE INVENTION

Figure 1:
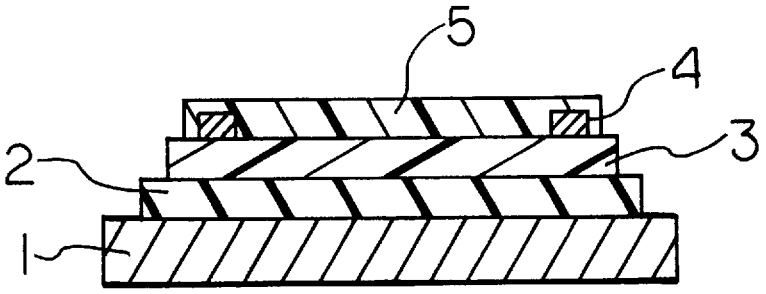
FIG. 1 is a sectional view of the example heating element.
Figure 2:
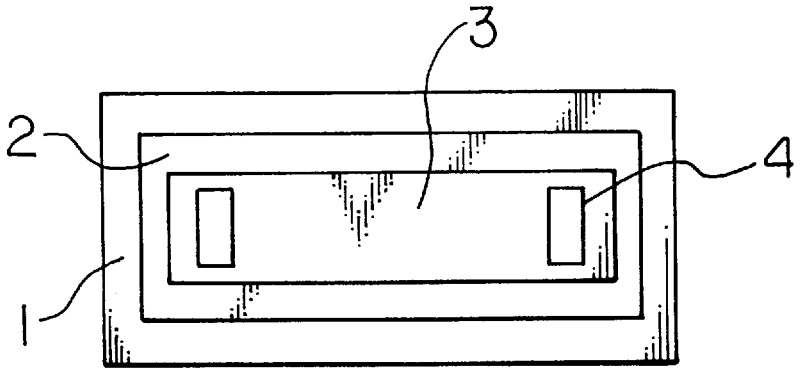
FIG. 2 is a top view of the example heating element.

The silicone resin used to make the electrically insulating layer, the electrically resistive layer and the electrically conducting areas of the heating element of this invention can be the same or different and are restricted only by their compatibility with each other and the substrate, their ability to be applied to the substrate and cured to a solid material, and their resistance to the temperature to be achieved by the element. Preferably, the silicones used in each of these layers have the same or a similar modulus versus temperature curve to prevent the generation of stress as the devices are repeatedly heated.

As long as the above objects are achieved, nearly any silicone resin can be used. Such resins are known in the art and can be produced by known techniques. Generally, these resins have the structure:

$$(R^1R^2R^3SiO_{0.5})_w(R^4R^5SiO)_x(R^6SiO_{1.5})_y(SiO_{4/2})_z$$

In this structure, $R^1$, $R^2$, $R^3$, $R^4$, $R^5$ and $R^6$ are independently selected from the group consisting of hydrogen and hydrocarbons of 1–20 carbon atoms. The hydrocarbons can include alkyls such as methyl, ethyl, propyl, butyl and the like, alkenyls such as vinyl, allyl and the like, and aryls such as phenyl. w, x, y and z in this structure comprise the molar ratio of the units with the total of w+x+y+z=1. Generally, any value for w, x, y and z which result in the formation of a branched polymer (resin, degree of substitution<1.8)) are functional herein (i.e., either y or z>0). Mixtures of resins are also useful herein.

In a preferred embodiment of the invention, at least one of the above R groups are phenyl. Such materials often form better coatings and have improved properties at high temperatures. Especially preferred silicone resins include units of the structure ($MeSiO_{3/2}$), ($MePhSiO_{2/2}$), ($PhSiO_{3/2}$) and ($Ph_2SiO_{2/2}$). Such resins are known in the art and commercially available.

Generally, silicone resins are diluted/dissolved in solvents for the processing herein. Suitable solvents are known in the art and can include, for example, organic solvents such as aromatic hydrocarbons (e.g., xylene, benzene or toluene), alkanes (e.g., n-heptane, decane or dodecane), ketones, esters, ethers, or inorganic solvents such as low molecular weight dimethylpolysiloxanes. The amount of solvent used varies depending on the resin, any additives and the processing but can be, for example, in the range of between about 10 and about 90 wt. % based on the weight of the resin.

The first layer of material in the present invention is characterized in that it is electrically insulating (insulating element). In a preferred embodiment, the first layer is also thermally conductive to transfer a high amount of heat from the electrically resistive layer. To achieve the electrical insulation and thermal conductivity, the first layer often includes a filler in addition to the silicone resin. Suitable thermally conductive, electrically insulating fillers are known in the art and can include, for example, alumina, silicon carbide, silicon nitride, zirconium diboride, boron nitride, silica, aluminum nitride, magnesium oxide, mixtures of the above and the like. Generally, these filler are included in an amount of greater than 30 wt. %, for example 50–90 wt. %, based on the weight of the resin. The second layer in the present invention is characterized in that it is electrically resistive (resistive element). To achieve this, the silicone resin is loaded with sufficient electrically conductive filler to form an electrically resistive layer (e.g., resistivity>0.1 ohm.cm). Such electrically conductive filler can include, for example, graphite, carbon black, silver, nickel, nickel coated graphite, silver coated nickel, and mixtures of the above. The amount of filler used in this layer varies depending on the filler but, generally it is in the range of greater than 5 wt. %, for example 10 to 80 wt. %, based on the weight of the resin. The third, electrically conductive material in the present invention is characterized in it comprises at least two separate areas, each of said areas being suitable for connection to a power supply (conductive elements). To achieve this, the silicone resin is loaded with sufficient electrically conductive filler to form electrically conductive material (e.g., resistivity<$10^{-3}$ ohm.cm.). Suitable electrically conductive fillers include, for example, silver, gold, platinum, nickel and the like. The amount of filler used is generally greater than 40 wt. %, for example 60 to 80 wt. %, based on the weight of the resin.

In a preferred embodiment of the invention, the heating element can have a fourth layer covering the top surface of the electrically resistive element (second layer) and the electrically conductive elements (third layer). This layer protects the elements from the environment (moisture, chemicals, etc.) and forms an insulating protective layer. The fourth layer can comprise any of the well known electrical protection compounds known in the electronics industry such as epoxy, polyimide, PCB, silicones and the like. In a preferred embodiment of the invention, the fourth layer is a silicone with the same or similar modulus versus temperature curve as the first three layers. Each of the above four layers may also contain other ingredients which are conventional in the formulation of silicone resins. These can include, for example, fillers such as fumed or precipitated silica, crushed quartz, diatomaceous earth, calcium carbide, barium sulfate, iron oxide, titanium dioxide, and the like, pigments, plasticisers, agents for treating fillers, rheological additives, adhesion promoters, and heat stabilising additives such as zirconium or titanium containing methyl polysiloxane. The proportions of such optional ingredients are tailored to deliver the desired properties to the layer.

The substrates used in the present invention include those which are conventionally used for heating elements and which are compatible with the final utility. These include, for example, metals such as anodised aluminum, aluminum, stainless steel, enameled steel or copper or a non-metallic substrate, e.g. polyimide or mica. Obviously, if the substrate is electrically insulating and can disperse the heat effectively, the first layer of electrically insulating material may not be necessary. The substrate may be a flat plate, a tube or may have any other configuration.

The heating elements of the present invention can be made by any desirable process. In a preferred embodiment of the invention, the heating elements are made by first supplying a substrate. The above composition comprising a silicone resin used to make the first layer is then applied on a surface of the substrate. This can be achieved by any of the well known techniques. These include, for example, dipping, spraying, painting, screen printing, etc.

The composition used to form the first layer is then cured. The time and temperature used to cure the composition will depend on the silicone used as well as any fillers or additives used. As an example, however, the composition can be cured by heating in a range of 150° to 400° C. for 1 to 4 hours. If desired, additional layers of the insulating material may be applied to assure electrical insulation. Next, the composition comprising a silicone resin and sufficient electrically conductive filler to form an electrically resistive element is applied on a surface of the electrically insulating layer. This composition can be applied via any of the methods described above for the first layer.

The composition used to form the second layer is then cured as with the first layer. In a preferred embodiment of the invention, however, the second layer is only partially cured at this stage. By 'partially cured' it is meant that the composition used to form the second layer has been cured to a state sufficient to prevent diffusion of the composition used to form the electrically conductive areas through it and yet not cured to its final state. By not completely curing the second layer, the inventors have discovered that the physical properties of the heating element are improved. The time and temperature used for the partial curing will depend on the silicone used as well as the fillers. Generally, however, the composition can be cured by heating in a range of 100° to 300° C. for 30 seconds up to several hours.

The third material comprising a silicone resin and sufficient electrically conductive filler to form electrically conductive areas is applied on at least two separate and distinct surfaces of the electrically resistive layer. These electrically conductive areas each allow for connection to a power supply. In a preferred embodiment, the third material is applied at 2 distinct distant ends of the electrically resistive layer. This material can be applied via any of the methods described above for the first layer.

The materials used to form the electrically conducting areas (and the second layer, if it was not previously cured) are then cured. As with the previous cure steps, the time and temperature used for the curing will depend on the silicone used as well as the fillers and additives. Generally, however, the compositions can be cured by heating in a range of range of 150° to 350° C. for 1 to 4 hours.

If desired, the electrically resistive layer and the electrically conducting areas can be coated with the composition used to form the top protective layer. This composition can be applied via any of the methods described above for the first layer. The composition used to form the fourth layer is then cured. As with the previous cure steps, the time and temperature used for the curing will depend on the material used as well as the fillers and additives. The resultant heating elements of the invention are especially suitable for use in areas where high temperature elements are required.

The applications include, for example, domestic appliances such as dry and steam irons, coffee machines, deep fryers, grills, space heaters, waffle irons, toasters, cookers, ovens, cooking hobs, water flow heaters, and the like, industrial equipment such as heaters, steam generators, process and pipe heating and the like and in the transportation industry such as for fuel and coolant preheating.

EXAMPLE

In order that the invention may become more clear there now follows a description to be read with the accompanying drawings of one example heating element according to the invention. In this description all parts are by weight unless the context indicates otherwise.

Example 1

The example heating element comprises a first electrically insulating layer (2) formed on an anodised aluminum base plate (1), an electrically resistive layer (3) on top of the insulating layer, and two electrically conductive areas (4) thereon which are suitable for connection to a power supply.

The heating element was formed by applying the composition used to form the first electrically insulating layer (2) onto an anodised aluminum base plate by means of a screen printer. This composition comprised 100 parts of a methyl phenyl silicone resin of the structure $(MeSiO_{3/2})_{0.25}$ $(MePhSiO_{2/2})_{0.5}$ $(PhSiO_{3/2})_{0.15}$ $(Ph_2SiO_{2/2})_{0.10}$ in 100 parts xylene, 190 parts of alumina supplied by Alcoa under the trade name CL3000FG and 10 parts of silica supplied by Cabot under the trade name Cabosil® LM150. The finished layer had a uniform thickness of about 100 microns. The layer was cured by heating to 250° C. for 1 hour.

The composition used to form the second electrically resistive layer (3) was applied on top of the insulating layer (2) by means of a screen printer. This composition comprised 100 parts of the same methyl phenyl silicone resin used in layer 1, in 100 parts xylene, 140 parts of graphite supplied by Lonza under the trade name SFG6 and 10 parts particles of carbon black supplied by Cabot under the trade name Vulcan XC72 R. The finished layer had a uniform thickness of about 75 microns.

The composition used to form the third electrically conductive elements was applied as two areas (4) on top of the electrically resistive layer (3) by dispensing the composition in the form of parallel tracks at either side of the electrically resistive layer (3). This composition comprised 100 parts of the same methyl phenyl silicone resin used in layers 1 and 2, in 100 parts xylene and 200 parts of silver flakes (type SF10E supplied by DEGUSSA). The second and third layers were finally cured by heating to 325° C. for 3 hours. The fourth insulating protective top layer (5) was applied covering the layer (3) and the areas (4). The material used to apply this layer was an addition cured highly filled silicone elastomer and was applied by screen printing and cured by heating to 150° C. for 30 minutes.

The resultant heating element was connected to a power supply of 220 volts at a specific power density of 10 watt/cm$^2$ and submitted to a test cycle of 1000 hours. This test simulated normal use of a heating element as an appliance unit and comprised:

1—heating the element for a period of 1 hour during which the temperature was regulated with a thermal switch keeping the temperature about 250° C.

2—switching off the power and allowing the element to cool to a temperature of 50° C. or below over a period of 30 minutes. No failure was observed.

The example heating element was also submitted to a continuous heating test. In one such test, the power remained stable at a temperature of 250° C. for 1000 hours. In a second test the power remained stable at a temperature of 170° C. for 1600 hours. Neither test resulted in a failure.

Example 2

The heating element of Example 2 was formed in a manner similar to Example 1. The composition used to form the first electrically insulating layer was applied to the anodised aluminum substrate as in Example 1 and comprised 75 parts of methyl phenyl silicone flakes having the structure: $(MeSiO_{3/2})_{0.45}$ $(MePhSiO_{2/2})_{0.05}$ $(PhSiO_{3/2})_{0.40}$ $(Ph_2SiO_{2/2})_{0.10}$ dissolved in 75 parts xylene, 25 parts of the methyl phenyl silicone resin used in Example 1 in 25 parts xylene, 180 parts of alumina supplied by Alcoa under the trade name CL3000FG and 10 parts of silica supplied by Cabot under the trade name Cabosil® TS720. The layer was cured by heating to 250° C. for 30 minutes.

A second layer of the same electrically insulating material used to form the first layer was applied on the first layer and cured by heating to 250° C. for 1 hour.

The composition used to form the electrically resistive layer was applied as in Example 1 and comprised 95 parts methyl phenyl silicone flakes described above in this Example dissolved in 95 parts xylene, 5 parts of the methyl phenyl silicone resin used in Example 1 in 5 parts xylene, 130 parts of graphite supplied by Lonza under the trade name SFG6 and 20 parts particles of carbon black supplied by Cabot under the trade name Vulcan XC72 R. The layer was partially cured by heating to 200° C. for 2 minutes under infra-red lamps.

The composition used to form the electrically conductive layer was applied as in Example 1 and comprised 100 parts of the methyl phenylsilicone resin used in Example 1 in 100 parts xylene and 200 parts of silver flakes (type SF10E supplied by DEGUSSA). The second and third layers were cured by heating to 300° C. for 1 hour.

The resultant heating element met European Standard EN 60335-1 relating to high voltage insulation and leakage at room temperature. The heating element was connected to a power supply of 220 volts at a specific power density of 20 watt/cm$^2$ and submitted to the test cycle of Example 1. No failure was observed. The power loss was less than or equal to 10%.

That which is claimed is:

1. A heating element comprising:

a substrate having a surface;

an electrically insulating layer on said surface of said substrate, said electrically insulating layer having a surface and obtained by curing a first composition, said first composition comprising a silicone resin;

an electrically resistive layer on said surface of said electrically insulating layer, said electrically resistive layer obtained by curing a second composition, said second composition comprising a silicone resin and sufficient electrically conductive filler to form an electrically resistive element; and at least two separate electrically conductive areas attached to said electrically resistive layer, each of said electrically conductive areas being suitable for connection to a power supply and obtained by curing a third composition, said third composition comprising a silicone resin and sufficient electrically conductive filler to form an electrically conductive element.

2. A heating element according to claim 1 wherein the substrate is selected from the group consisting of anodised aluminum, aluminum, stainless steel, enameled steel, and copper.

3. A heating element according to claim 1 wherein said first composition further comprises a thermally conductive filler selected from the group consisting of alumina, silicon carbide, silicon nitride, zirconium diboride, boron nitride, silica, aluminum nitride, magnesium oxide and mixtures thereof.

4. A heating element according to claim 1 wherein said electrically conductive filler of said second composition is selected from the group consisting of graphite, carbon black, silver, nickel, nickel coated graphite, silver coated nickel, and mixtures thereof.

5. A heating element according to claim 1 wherein said electrically conductive filler of said third composition is selected from the group consisting of silver, gold, platinum, nickel, and mixtures thereof.

6. A heating element according to claim 1 wherein the silicone resin of said first composition, the silicone resin of said second composition and the silicone resin of said third composition comprise silicon-bonded phenyl groups.

7. A heating element according to claim 1 wherein an insulating protective top layer covers the electrically resistive layer and the electrically conductive areas.

8. A heating element comprising:

a substrate having a surface and comprising an electrically insulating, thermally conductive material;

an electrically resistive layer of material on said surface of said substrate, said electrically resistive layer of material obtained by curing a composition comprising a silicone resin and sufficient electrically conductive filler to form an electrically resistant element; and at least two separate electrically conductive areas attached to said electrically resistive layer, each of said electrically conductive areas being suitable for connection to a power supply and obtained by curing a third composition, said third composition comprising a silicone resin and sufficient electrically conductive filler to form an electrically conductive element.

9. A process of manufacturing a heating element comprising:

supplying a substrate having a surface;

applying a first composition comprising a silicone resin on said surface of said substrate;

curing said first composition to form an electrically insulating layer having a surface;

applying a second composition comprising a silicone resin and sufficient electrically conductive filler to form an electrically resistive element on said surface of said electrically insulating layer;

heating the second composition for a time and at a temperature sufficient to partially cure the second composition and form a partially cured electrically resistive layer having a surface, applying a third composition to said surface of said partially cured electrically resistive layer to form at least two separate areas, each of said at least two separate areas being suitable for connection to a power supply, and said third composition comprising a silicone resin and sufficient electrically conductive filler to form electrically conductive elements; and curing the second and third compositions.

10. A process of manufacturing a heating element comprising:

supplying an electrically insulating, thermally conductive substrate having a surface;

applying a first composition comprising a silicone resin and sufficient electrically conductive filler to form an electrically resistive element on said surface of said substrate;

heating the first composition for a time and at a temperature sufficient to partially cure the first composition to form a partially cured electrically resistive layer having a surface;

applying a second composition to said surface of said partially cured electrically resistive layer to form at least two separate areas, each of said at least two separate areas being suitable for connection to a power supply, and said second composition comprising a silicone resin and sufficient electrically conductive filler to form electrically conductive elements; and curing the first and second compositions.

11. A process of manufacturing a heating element comprising:

supplying a substrate having a surface;

applying a first composition comprising a silicone resin on said surface of said substrate;

curing the first composition to form an electrically insulating layer having a surface;

applying a second composition comprising a silicone resin and sufficient electrically conductive filler to form an electrically resistive element on said surface of said electrically insulating layer;

curing the second composition to form an electrically resistive element;

applying a third composition to said surface of said electrically resistive element to form at least two separate areas, each of said at least two separate areas being suitable for connection to a power supply, and said third composition comprising a silicone resin and sufficient electrically conductive filler to form electrically conductive elements; and curing the third composition to form electrically conductive elements.

* * * * *